United States Patent [19]

Vallis

[11] 3,949,765

[45] Apr. 13, 1976

[54] BRUSH FOR USE WITH HAIRDRYERS

[76] Inventor: Joseph Vallis, 353 Cortleigh Blvd., Toronto, Ontario, Canada

[22] Filed: Oct. 15, 1974

[21] Appl. No.: 515,007

[52] U.S. Cl. ..... 132/11 R; 34/96

[51] Int. Cl.[2] ..... A45D 24/00

[58] Field of Search ..... 132/11 A, 11 R, 9; 15/159, 15/167, DIG. 5, DIG. 6; 34/96

[56] References Cited

UNITED STATES PATENTS

| | | | |
|---|---|---|---|
| 2,136,595 | 11/1938 | Rogers | 15/DIG. 5 |
| 3,103,679 | 9/1963 | Clemens | 15/DIG. 6 |
| 3,265,075 | 8/1966 | Edman et al. | 132/9 |
| 3,744,078 | 7/1973 | Vallis | 15/DIG. 5 |
| 3,840,030 | 10/1974 | Baker | 132/11 A |

FOREIGN PATENTS OR APPLICATIONS

| | | | |
|---|---|---|---|
| 1,057,279 | 10/1953 | France | 15/167 |
| 1,203,916 | 8/1959 | France | 15/DIG. 6 |

*Primary Examiner*—G. E. McNeill
*Attorney, Agent, or Firm*—Michael J. Striker

[57] ABSTRACT

A brush has a support member which is provided with a plurality of apertures and which has at one side hook-shaped connectors for releasably fastening it across an opening of a hairdryer through which heated air is expelled. At the other side the carrier has tufts of bristles each of which tufts is composed of a number of shorter and softer bristles and at least one longer and harder bristle which projects beyond the shorter bristles.

A combination of a hairdryer and the brush described above is also disclosed.

17 Claims, 5 Drawing Figures

BRUSH FOR USE WITH HAIRDRYERS

BACKGROUND OF THE INVENTION

The present invention relates generally to a brush for use with electric hairdryers, and to an electric hairdryer using such a brush.

Various kinds of electric hairdryers have been known for a long time, and are usually either of the type which is mounted on a support and has a hood under which the user must sit, or they are small units connected by means of a flexible hose with a plastic hood which is worn by the user who has freedom of movement within a limited range due to the presence of the flexible hose.

More recently a different kind of hair dryer has become popular, the hand-held type which the user moves over his or her head to direct the stream of heated air wherever it is desired.

SUMMARY OF THE INVENTION

It is a general object of the present invention to provide an improved hairdryer of the type whose stream of heated air can be directed locally to whichever part of the head is desired, and which is provided with a novel brush making it possible at the same time to not only dry but also brush the hair.

Another object of the invention is to provide a novel brush for use with such a hairdryer.

An additional object of the invention is to provide such a novel brush which will provide not only for brushing of the hair, but also for stimulation of the scalp.

In keeping with these objects, and other which will become apparent hereafter, one feature of the invention resides in an electric hairdryer having, in combination, a housing an interior of which communicates with the outside via an outlet opening. Electric heating means is provided in the interior, and an electrically operated blower is also located in the interior and operative for expelling through the outlet opening a stream of air heated by the heating means. A brush has a carrier member one side of which faces the opening, and a plurality of tufts of bristles projecting from an opposite side of the member and each being composed of a plurality of shorter softer bristles and at least one longer harder bristle. Connecting means is provided for releasably connecting the member with the housing in a position extending across the opening in the path of the stream of air.

The construction of the hairdryer itself is known per se. Such hairdryers are available commercially in various types and under various trademarks, including a unit marketed under the name "Max" by the Gilette Company. The novel brushs itself, as well as its combination with such a dryer is, however, not known and offers unexpected and substantial advantages.

The novel features which are considered as characteristic for the invention are set forth in particular in the appended claims. The invention itself, however, both as to its construction and its method of operation, together with additional object and advantages thereof, will be best understood from the following description of specific embodiments when read in connection with the accompanying drawings.

DESCRIPTION OF THE PREFERRED EMBODIMENTS

Figure 1:
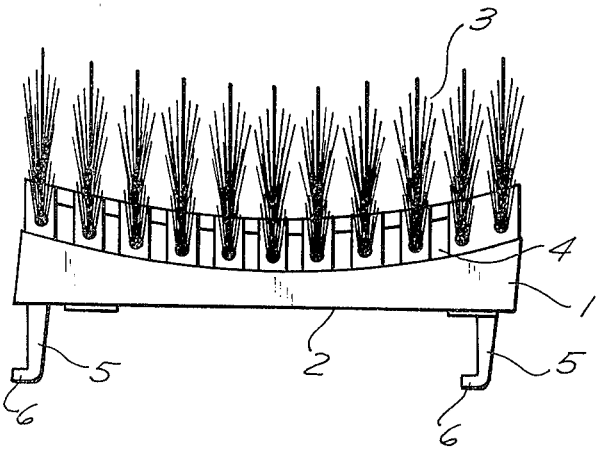
FIG. 1 is a side view of a novel brush according to my present invention.
Figure 2:
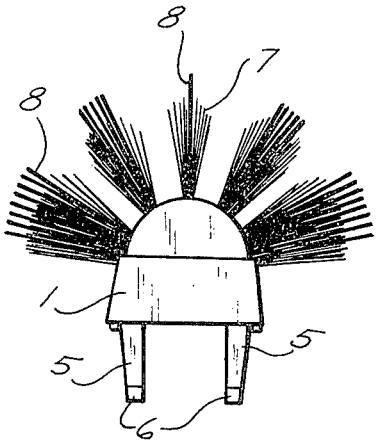
FIG. 2 is an end view of the brush shown in FIG. 1.

Discussing the drawing in detail, and firstly the brush shown in FIGS. 1 and 2, it will be seen that reference numeral 1 identifies a carrier member which may be made of synthetic plastic material and is substantially semi-cylindrical in its configuration, being hollow. At the side 2 the interior of the member 1 is open, and the peripheral wall of the member 1 is provided with a plurality of apertures 4 so that air blown into the open side of the member 1 can escape through these apertures 4. The upper or outer side 3 of the member 1 is arcuately recessed in the direction towards the side 2, and at the side 2 the member 1 is provided with connecting portions, here configurated as essentially L-shaped legs having a straight portion 5 and an angled portion 6. By means of these legs member 1 can be releasably connected with a hairdryer, for instance by having the portions 6 snap under abutments provided on the hairdryer.

The outer side of the member 1 is provided with a plurality of tufts of bristles which are advantageously arranged in rows. Each of these tufts of bristles comprises a plurality of softer shorter bristles 7 and at least one longer harder bristle 8. Of course, the longer bristles 8 will project outwardly beyond the free ends of the shorter bristles 7. It is also possible to provide at least one additional bristle whose length corresponds to that of the shorter bristles 7 but which is as hard or as stiff as the bristles 8. The bristles 7 essentially serve to brush the hair of the user, whereas the bristles 8 penetrate through the hair to the scalp and massage the scalp as the brush is moved over the head.

In so doing, the bristles 8 serve a two-fold purpose. They part the hair as the brush is moved through the same, and this facilitates the flow of air from the hairdryer (to be discussed subsequently) into the hair. This results evidently in a better and speedier drying action.

Moreover, and this is of even greater importance, the rounded free ends of the bristles 8 have a toning effect on the scalp, stimulating the blood circulation and removing contaminants (dust, dandruff, residual hair-lotion and/or hair-spray matter) which normally clog the pores of the skin, so that the latter can properly breathe again. The overall result of this second function is that the novel brush has a resuscitating effect on the hair growth, tending to counteract the state of desuetude or decay into which the hair follicles normally fall due to lack of stimulation of the blood circulation combined with inadequate breathing of the skin which results from clogged pores.

The bristles 7 and 8 are advantageously also made of synthetic plastic material, for instance nylon although other materials can be utilized. Their inner ends are imbedded in the material of the member 1.

Figure 3:
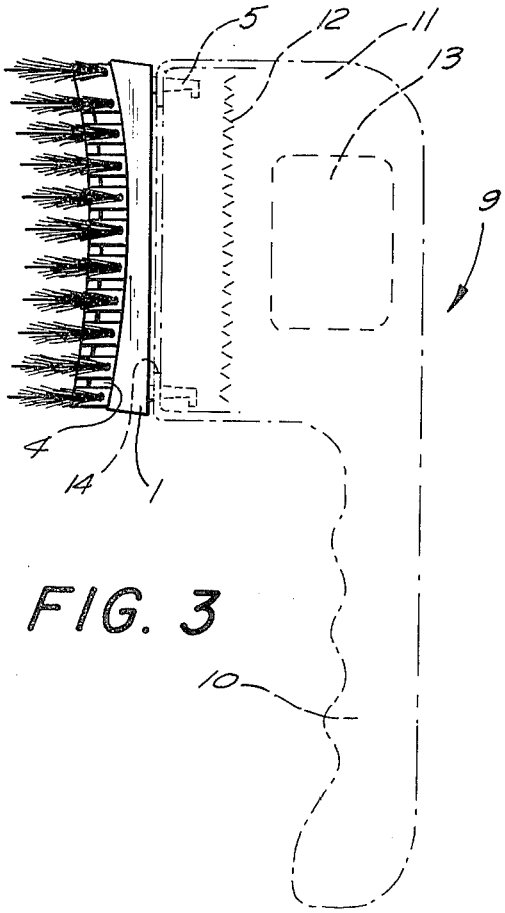
FIG. 3 is a plan view of a hairdryer provided with a brush of the type shown in FIGS. 1 and 2.

Coming now to FIG. 3 it will be seen that here I have illustrated a hairdryer having a housing 9 which may or may not be provided with a handle portion 10. Located in the interior of the housing 9, and illustrated only diagrammatically because they are known from the art both as to their construction and as to their function, are a heating means 12 such as a resistance heater, and a blower 13, both electrically operated. The interior of the housing is identified with reference numeral 11 and has an opening 14 through which air heated by the element 12 is expelled by the blower 13.

The brush of FIGS. 1 and 2 is mounted on the housing so as to extend across the opening, with its legs 5, 6 being releasably connected with the housing to hold the brush in place on the same. Air expelled by the blower 13 passes into the hollow interior of the member 1 and from there to the outside through the apertures 4. The air passes around the tufts of bristles into contact with the hair of a user.

In operation, the hairdryer is moved by the user over the hair to thereby direct the stream of heated air to different parts of the head and dry the hair. At the same time the bristles, which are placed in contact with the hair, brush the hair, this being a function of the bristles 7. The projecting portions of the bristles 8, that is the portions projecting beyond the bristles 7, penetrate through the hair and massage the scalp as the hairdryer is moved about.

If it is desired to use the hairdryer without the brush, either for hairdrying purposes or, as is a widespread practice among female users, to dry small items of lingerie, the brush can simply be removed and later be re-connected.

Figure 4:
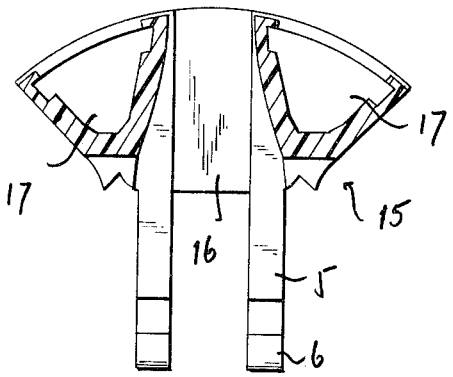
FIG. 4 is a transverse section through a further embodiment.

FIG. 4 shows another type of carrier member for use in accordance with the concepts of this invention. Here, the carrier member 15 has a center air slot 16 between two transversely spaced trough-shaped portions 16 which extend along the slot 16. The legs correspond to the legs 5, 6 in the embodiment of FIG. 1. Bristles have been omitted for the sake of clarity, but it will be understood that the bristle tufts are to be mounted in the trough-shaped portions 17, for instance by potting their lower ends, i.e. filling the troughs of the portions 17 with solidifiable material (e.g. rubber, plastic) and embedding the lower ends of the bristles in this material.

Figure 5:
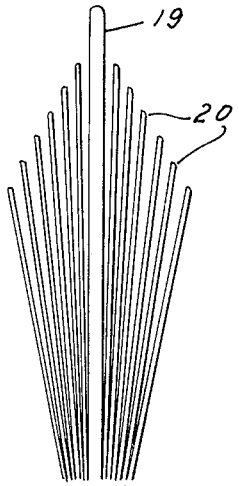
FIG. 5 is a diagrammatic elevation, showing another feature according to the invention.

FIG. 5, finally, shows that the tufts of bristles can also be configurated differently from what is illustrated in FIG. 1. A single tuft 18 is shown, having one or more stiff bristles 19 and a plurality of additional bristles which are less stiff. These additional bristles are identified with reference numeral 20 and may be continuously graduated in their length, i.e. some may be shorter than the bristle 19 by ¼ inch, others by ½ inch, still others by ¾ inch, and so on. Other length variations could also be selected, e.g. graduations of ⅛ inch. However, there may be a fixed number of graduations, for instance three. Generally speaking, the length of the bristle 20 may range between about ½ and ¾ of the length of the bristle 19, and within this range of bristles 20 of a tuft may be graduated in size either continuously or in steps.

It will be understood that each of the elements described above, or two or more together, may also find a useful application in other types of constructions differing from the types described above.

While the invention has been illustrated and described as embodied in a brush for use with electric hairdryers, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A brush for use with an electric hairdryer, comprising a support member having two sides; connecting means at one of said sides for detachably connecting said member to a hairdryer in the path of heat emitted by the latter; and a plurality of tufts of bristles projecting from the other of said sides, said tufts each comprising a plurality of shorter softer bristles and at least one longer stiffer bristle which projects beyond said shorter bristles.

2. A brush as defined in claim 1, wherein said member is provided with a plurality of apertures extending from said one to said other of said sides so as to permit passage of heated air therethrough.

3. A brush as defined in claim 1, wherein said member has a central slot extending from one to the other of said sides for passage of heated air through said slot, and at least one trough-shaped recess extending along each side of said slot; said tufts of bristles having lower end portions anchored in the respective recesses.

4. A brush as defined in claim 1, wherein at least said member is of synthetic plastic material.

5. A brush as defined in claim 1, wherein at least said bristles are of synthetic plastic material.

6. A brush as defined in claim 1, wherein said other side is arcuately recessed in direction towards said one side.

7. A brush as defined in claim 1, wherein all of said shorter bristles have a first identical length, and all of said second bristles have a longer identical length.

8. A brush as defined in claim 1; further comprising an additional bristle provided in each of said tufts and having a length corresponding to said shorter bristles, but being as stiff as said longer bristles.

9. In an electric hairdryer, a combination comprising a housing having an interior which is provided with an outlet opening; electric heating means in said interior; an electrically operated blower also in said interior and operative for expelling through said outlet opening a stream of air heated by said heating means; a brush having a carrier member one side of which faces said opening, and a plurality of tufts of bristles projecting from an opposite side of said member and each being composed of a plurality of shorter softer bristles and at least one longer stiffer bristle; and connecting means for releasably connecting said member with said housing in a position extending across said opening in the path of said stream of air.

10. A combination as defined in claim 9, wherein said connecting means comprises substantially L-shaped projections extending from said one side of said member.

11. A combination as defined in claim 9, wherein at least said carrier member of said brush is of synthetic plastic material.

12. A combination as defined in claim 9, wherein at least said bristles of said brush are of synthetic plastic material.

13. A combination as defined in claim 9, wherein said carrier member is provided with a plurality of apertures extending between said sides thereof for permitting the passage of said stream of air.

14. A brush for use with an electric hairdryer, comprising a support member having two sides; connecting means at one of said sides for detachably connecting said member to a hairdryer in the path of heat emitted by the latter; and a plurality of tufts of bristles projecting from the other of said sides, said tufts each comprising at least one long stiff bristle and a plurality of shorter softer bristles whose length ranges between substantially ½ and ¾ of the length of said long stiff bristle.

15. A brush as defined in claim 14, wherein said softer bristles comprise bristles of at least three different lengths.

16. A brush as defined in claim 14, wherein the length of said softer bristles ranges between substantially one-half and three-quarters of the length of said long stiff bristle in three graduations.

17. A brush as defined in claim 1, wherein all of said longer stiffer bristles of each tuft are surrounded by all of said shorter, softer bristles of each tuft.

* * * * *